US008262433B2

(12) United States Patent
Castellano

(10) Patent No.: US 8,262,433 B2
(45) Date of Patent: Sep. 11, 2012

(54) BRA CUP FOR INCREASING VISUAL APPEARANCE OF BREAST SIZE, AND BRASSIERE INCORPORATING THE SAME

(75) Inventor: Steven Castellano, Middletown, NJ (US)

(73) Assignee: Maidenform, Inc., Iselin, NJ (US)

( * ) Notice: Subject to any disclaimer, the term of this patent is extended or adjusted under 35 U.S.C. 154(b) by 134 days.

(21) Appl. No.: 12/641,419

(22) Filed: Dec. 18, 2009

(65) Prior Publication Data

US 2010/0273395 A1 Oct. 28, 2010

Related U.S. Application Data

(60) Provisional application No. 61/172,885, filed on Apr. 27, 2009.

(51) Int. Cl.
*A41C 3/00* (2006.01)

(52) U.S. Cl. ..... 450/39; 450/54; 450/36; 2/267

(58) Field of Classification Search ..... 450/36–39, 450/54–58, 1; 2/267, 268; 623/7, 8
See application file for complete search history.

(56) References Cited

U.S. PATENT DOCUMENTS

| | | | | |
|---|---|---|---|---|
| 2,834,352 | A * | 5/1958 | Ullian | 450/57 |
| 3,181,536 | A * | 5/1965 | Cannata | 450/57 |
| 3,834,397 | A * | 9/1974 | Birch | 450/56 |
| 4,143,662 | A * | 3/1979 | Fisher | 450/53 |
| 4,372,321 | A * | 2/1983 | Robinson | 450/39 |
| 6,443,806 | B1 * | 9/2002 | Fang | 450/57 |
| 6,814,647 | B1 * | 11/2004 | Huang | 450/39 |
| 6,824,444 | B2 | 11/2004 | Huang | |
| 7,044,829 | B1 * | 5/2006 | Jagaric et al. | 450/54 |
| 7,527,543 | B2 | 5/2009 | Chang | |
| 7,556,553 | B2 * | 7/2009 | Falla et al. | 450/39 |
| 7,666,059 | B2 * | 2/2010 | Falla et al. | 450/39 |
| 7,922,560 | B2 | 4/2011 | Avalos-Dessner et al. | |
| 2006/0025041 | A1 * | 2/2006 | Falla et al. | 450/39 |
| 2006/0052034 | A1 * | 3/2006 | Falla et al. | 450/39 |
| 2006/0094333 | A1 * | 5/2006 | Wood et al. | 450/39 |
| 2008/0090491 | A1 | 4/2008 | Liu | |
| 2009/0233523 | A1 | 9/2009 | Pardo et al. | |

FOREIGN PATENT DOCUMENTS

| | | | |
|---|---|---|---|
| FR | 2 221 090 | A1 | 10/1974 |
| GB | 128882 | A | 7/1919 |
| GB | 2 462 500 | A | 2/2010 |
| JP | 11-229206 | A | 8/1999 |
| JP | 2006-193861 | A | 7/2006 |
| JP | 2007-303013 | A | 11/2007 |
| JP | 2008-075191 | A | 4/2008 |
| TW | 200845920 | A | 12/2008 |
| WO | WO-2006/088871 | A2 | 8/2006 |

* cited by examiner

*Primary Examiner* — Gloria Hale
(74) *Attorney, Agent, or Firm* — Dickstein Shapiro LLP

(57) ABSTRACT

A bra cup includes: an inner cup portion, comprising one or more inner foam layers; and an outer cup portion, attached to the inner cup portion, comprising one or more outer foam layers, the inner cup portion and the outer cup portion together forming the bra cup. The inner foam layers form first and second convex portions with respect to an inner surface of the inner cup portion. The first and second convex portions form, at an intersection therebetween, a channel on the inner surface extending from a lower portion of the cup towards an apex of the bra cup.

17 Claims, 3 Drawing Sheets

BRA CUP FOR INCREASING VISUAL APPEARANCE OF BREAST SIZE, AND BRASSIERE INCORPORATING THE SAME

CROSS-REFERENCE TO RELATED APPLICATION

This application claims benefit under 35 U.S.C. 119(e) of U.S. Provisional Application No. 61/172,885, filed Apr. 27, 2009.

FIELD OF THE INVENTION

The present invention relates to a bra cup, and a brassiere ("bra") using the bra cup, that increases the visual appearance of the size of a wearer's breast, more particularly, to a bra cup that increases the visual appearance of a wearer's breast by two (2) cup sizes.

BACKGROUND OF THE INVENTION

Techniques for increasing the appearance of a woman's bustline have included, for example, plastic surgery in which soft implants are inserted into the breast, to increase the cup size by one or more sizes. However, while many women would like the appearance of a larger bust, not all women want to go through the surgery and the associated recovery process, still less the possible complications. There is therefore a need to have a way of increasing the apparent size and shape of the breast, without the need for invasive surgical procedures.

SUMMARY OF THE INVENTION

In accordance with a first aspect of the invention, a bra cup is provided which includes: an inner cup portion, comprising one or more inner foam layers; and an outer cup portion, attached to the inner cup portion, comprising one or more outer foam layers, the inner cup portion and the outer cup portion together forming the bra cup. The inner foam layers form first and second convex portions with respect to an inner surface of the inner cup portion. The first and second convex portions form, at an intersection therebetween, a channel on the inner surface extending from a lower portion of the cup towards an apex of the bra cup.

In accordance with a second aspect of the invention, a bra is provided which includes: (a) two bra cups, adjacent to one another at inner edge portions thereof, each bra cup including: an inner cup portion, comprising one or more inner foam layers; and an outer cup portion, attached to the inner cup portion, comprising one or more outer foam layers, the inner cup portion and the outer cup portion together forming the bra cup, the inner foam layers forming first and second convex portions with respect to an inner surface of the inner cup portion, the first and second convex portions forming, at an intersection therebetween, a channel on the inner surface extending from a lower portion of the cup towards an apex of the bra cup; and (b) at least one bra wing extending from outer edge portions of the bra cups.

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which.

DETAILED DESCRIPTION OF THE PREFERRED EMBODIMENTS

The bra cup in accordance with preferred embodiments will next be described making reference to the figures. Such figures are intended to be illustrative rather than limiting and are included herewith to facilitate the explanation of exemplary features of the embodiments of the invention. Unless otherwise noted, the figures are not to scale, and are not intended to serve as engineering drawings.

Figure 1:
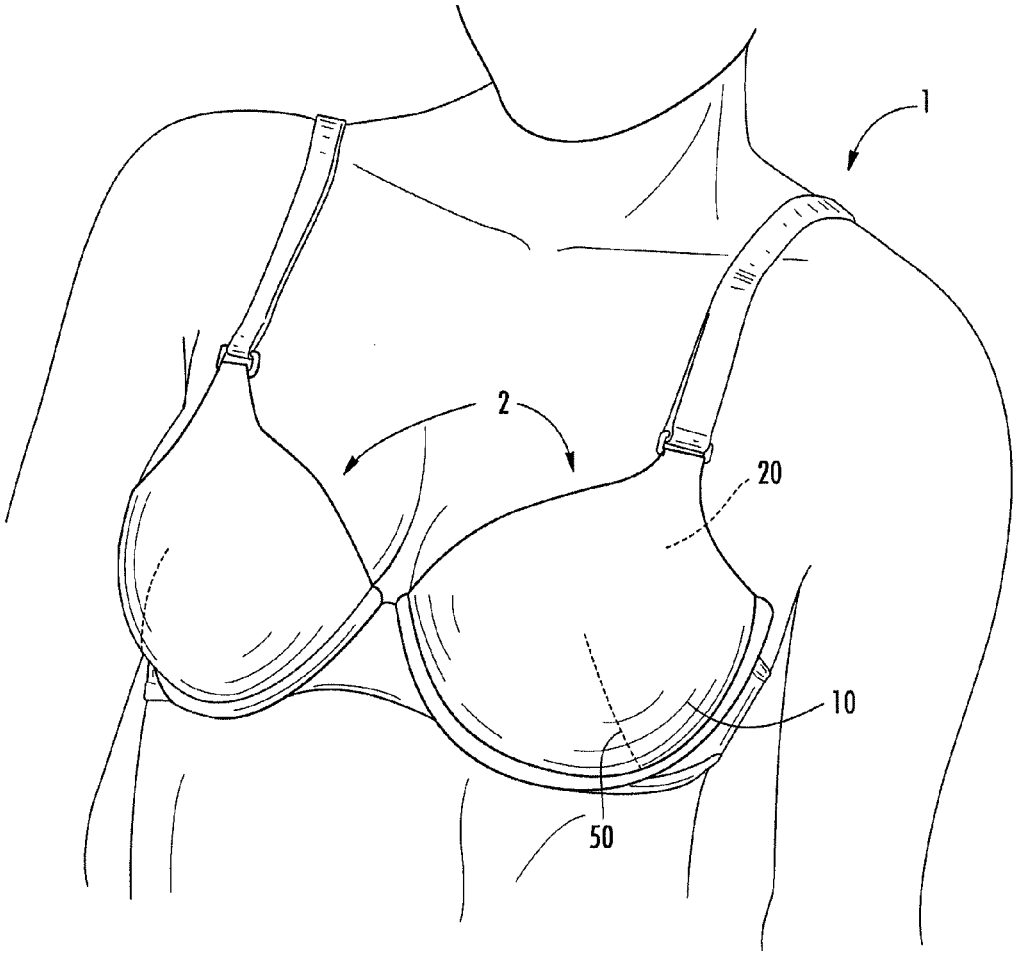
FIG. 1 is a perspective view of a brassiere having bra cups in accordance with the present invention, secured about the torso of a wearer.
Figure 2:
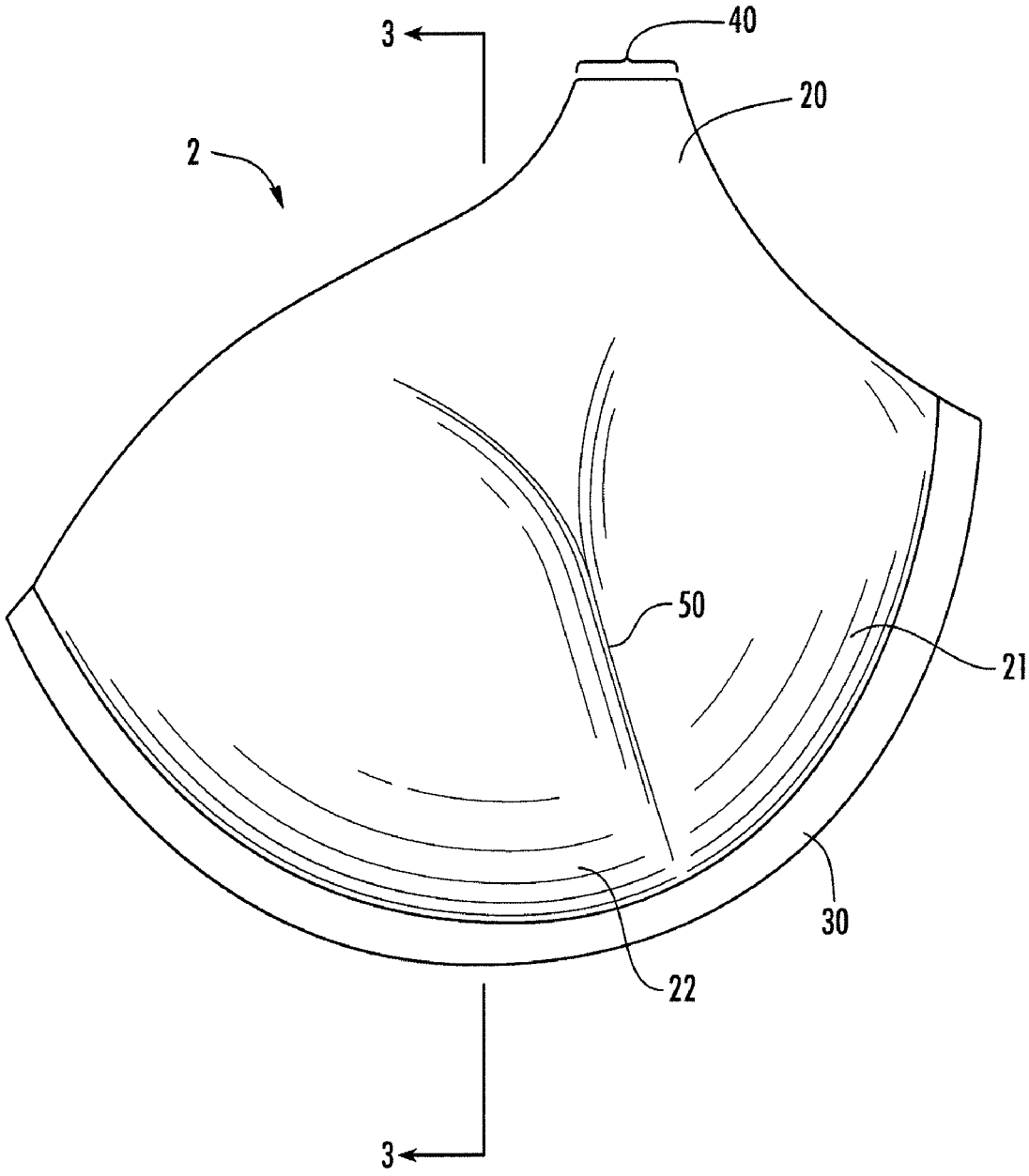
FIG. 2 is a plan view of the inside surface of the wearer's right side bra cup shown in FIG. 1.
Figure 3:
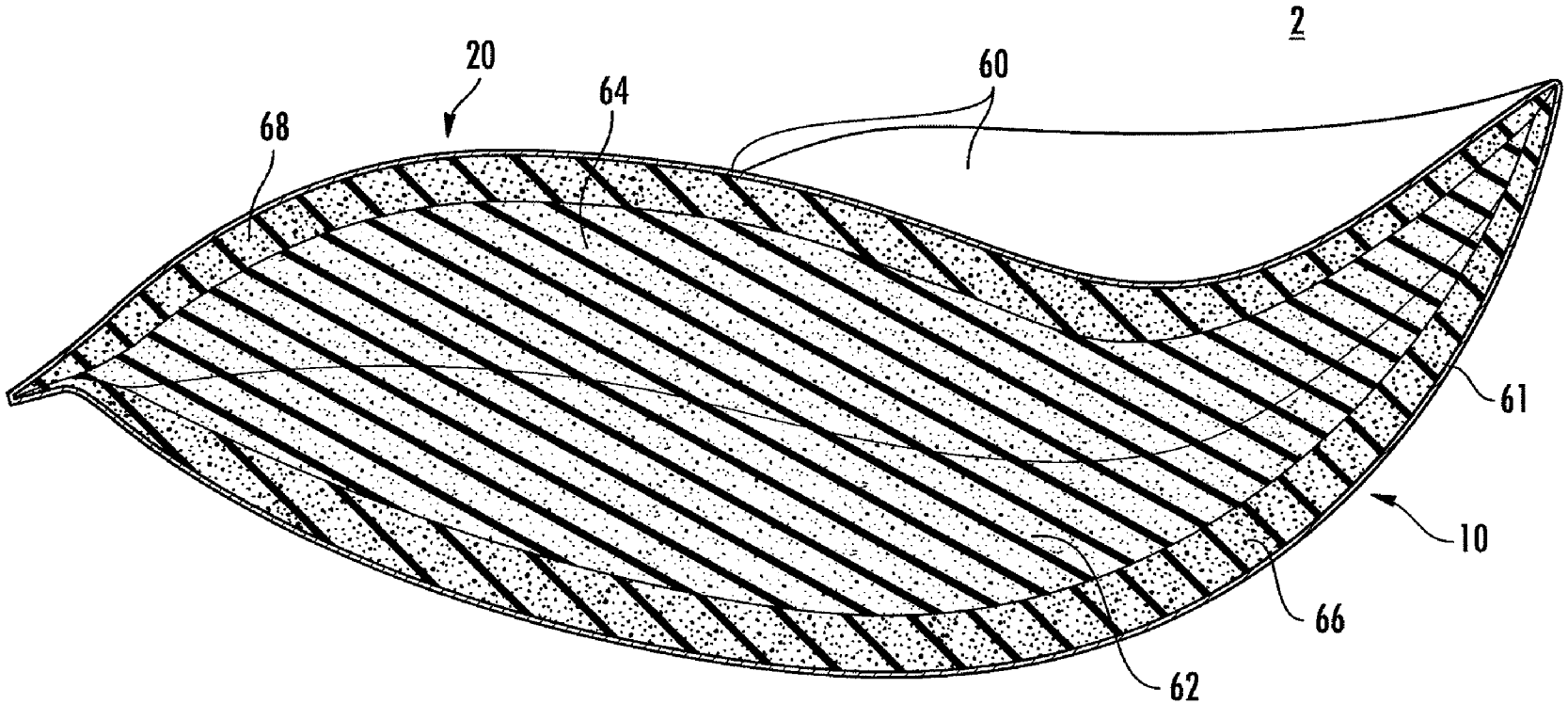
FIG. 3 is a cross-sectional view of the bra cup of FIGS. 1 and 2, taken along line 3-3.

Referring now to the drawings wherein like numerals indicate like elements, a first embodiment of a brassiere having a bra cup constructed in accordance with the principles of the present invention, and designated generally as bra cup 2, is shown in FIGS. 1-3. FIG. 1 shows the brassiere 1 secured around the torso of a wearer. The bra cups 2 of the brassiere 1 include an outer cup section 10 and an inner cup section 20, the inner cup section 20 being configured to contact the breasts of a wearer. The brassiere 1 is also shown as including shoulder straps and wings to assist in securing the brassiere around the torso of a wearer. It will be evident to one of skill in the art that various brassiere configurations, such as strapless, rear hook and front hook, can incorporate the bra cups 2 of the present invention.

As shown in FIG. 2, the inner bra cup section includes two portions 21 and 22, designed to work cooperatively together such that portion 21, which comprises a convexity in the inner part of the bra cup, pushes the breast of the wearer in, i.e., toward the opposite breast, while portion 22, comprising a second a convexity on the inner portion of the bra cup, pushes the breast up, towards the neckline of the wearer. The first portion 21 is preferably made smaller in the width direction of the bra cup 2 than the second portion 22. It should be appreciated, however, that the proportioning of the first section 21 and second section 22 can be altered depending on the size and shape of the breast of the wearer. Accordingly, it is contemplated that under certain size and shape circumstances, the second section 22 could be the same size or smaller in the width direction than the first section 21.

The first portion 21 and the second portion 22 are preferably formed as an integral piece of foam material during the molding of the bra cup 2. It is also contemplated that the first portion 21 and the second portion 22 can be formed from separate foam pieces. Although the presently preferred embodiment of the inner bra cup section 20 is described as having two portions for moving the breast upward toward the neckline and inward toward the opposing breast, the bra cup of the present invention can be formed using more than two or less than two sections to achieve the desired combination of support and augmentation for any particular size and shape breast.

In the illustrated embodiment of the inner bra cup section shown in FIG. 2, the convex shapes of the portions 21 and 22 cooperate together to form, at their intersection, a channel 50 that extends in a generally vertical direction in the bra cup. Preferably, the direction of the channel 50 is oriented so as to point in the direction of the apex of the outer bra cup section.

The bra cup 2 also preferably includes a flange 30 which extends along the entire lower edge of the bra cup 2 and is designed to rest against torso of the wearer underneath the breast and provide support thereto. In certain embodiments of the bra cup of the present invention configured for larger breasted women, the flange 30 will incorporate an underwire (not shown) for additional support of the breast. The bra cup 2 is also preferably shaped so as to include a platform 40 to which an optional bra strap (as shown in FIG. 1) is attached. It will be readily evident to one of skill in the art that the bra cup will be shaped without a platform if the brassiere is to be strapless.

As shown in greater detail in the cross section of FIG. 3, the bra cup 2 is preferably formed of several layers of foam or fiberfill bonded together, the layers being shaped and sized, and in particular varied in thickness along the vertical and horizontal direction, e.g., by a molding process, so as to provide lift, and the appearance of a larger cup size, as discussed above. In particular, the shape of the foam layers is varied such that the inner bra cup section 20 is shaped to accommodate a first breast size, while the outer bra cup section 10 is shaped so as to provide the appearance of a second, larger size, preferably at least one (1) cup size larger than that accommodated by the inner bra cup section 20, and most preferably two (2) cup sizes larger than that accommodated by the inner bra cup section 20. Further, the shape of the inner bra section 20 is varied to provide an upward, and inward (i.e., towards the opposite breast) lift to give a fuller appearance to the bustline.

The outer bra cup section 10 includes a layer of fabric material 61 laminated to an outer layer of foam 66. It is preferred that the fabric and foam of the outer bra cup section 10 be formed from a continuous piece of material, e.g., one that is seamless, so as to provide a smooth overall outer appearance to the bra cup 2, which in turn creates a clean line underneath the clothing of a wearer.

The inner bra cup section 20 also includes a layer of fabric material 60 laminated to an inner layer of foam 68. It is also preferred that the fabric and foam of the inner bra cup section 20 be formed from a continuous piece of material with the first and second portions 21 and 22 being formed and shaped during a molding process, i.e., to form the convexities discussed above. As noted above, however, the inner bra cup section 20 can be formed from multiple pieces of material to form the first and second portions 21 and 22.

Preferably, the cup is formed using a molding process that is performed on bra cup including the outer and inner liners 60 and 61. However, as would be appreciated by one of skill in the art, the outer and inner liners could also be attached in a separate process.

The bra cup also includes first and second inner layers of foam material 62 and 64, preferably fiberfill or other polyester foam material, attached to each of the outer cup section 10 and inner cup section 20, respectively. The first and second inner layers of foam material 62 and 64 together form a foam insert that is shaped and positioned between the outer and inner bra cup sections 10 and 20. While it is currently preferred that the foam insert be constructed out of two inner layers, one of ordinary skill in the art would recognize that the foam insert could be made of a single piece of foam, or from more than two pieces of foam.

The layers of the bra cup are molded in a molding machine, so that the overall bra cup 2 is thicker at the apex (the outer, upper portion of the cup) so as to provide the appearance and projection of a larger breast, i.e., one having the larger cup size of the outer bra cup section 10.

In a currently preferred process, the bra cup may be formed from a first layer, e.g., comprising the liner 60 laminated to the foam layer 68, a second layer, which would be the thickest layer and comprise the foam insert, and a third layer, comprising the liner 61 laminated to the foam layer 66. Preferably in forming the cup, the first layer and the second layer are first pre-shaped via an initial molding process to attain a desired shape. Then, the first, second and third layers are sprayed with a resin or glue, or other boding agent. Finally all the layers are compiled together and molded into the desired overall shape.

The combination of the differently sized and shaped outer and inner bra cup sections 10 and 20, and the shapes of the first and second portions 21 and 22 of the inner bra cup section 20 that push the breast of the wearer upward and inward toward the opposite breast, create the perception of a cup size larger than the natural size of the breast of the wearer, preferably at least two (2) cup sizes larger, while at the same time augmenting the breast into a desirable round shape.

Although the presently preferred embodiment of the bra cup 2 is shown and described as having two inner layers of foam material, the bra cup of the present invention can be formed using more than two or less than two inner layers of foam material to achieve the desired appearance of proper projection of the breast for any particular cup size of the outer bra cup section 10.

The various layers of the outer bra cup section 10, the inner bra cup section 20, and the inner foam layers 62 and 64, are preferably laminated to each other using a heat activated resin, an adhesive or any other appropriate binding agent or method. Liners 60 and 61 are also preferably laminated to foam layers 68 and 66, respectively. The foam material used in the bra cup is preferably polyester, but may be any other foam that is suitable for bra construction, including but not limited to fiberfill and memory foam.

It should be noted that although the number of layers of material in each of the inner and outer bra cup sections of the presently preferred embodiment has been described herein with respect to a particular number of layers, the actual number of layers in the bra cup may vary based on specific requirements of the bra cup being constructed, such as for a particular breast size and shape. Accordingly, the number of layers of material shown in the presently preferred embodiment of FIGS. 1-3 is merely illustrative and in no way excludes other combinations of layers that may be employed by one of ordinary skill in the art to achieve the benefits of the present invention.

Although the present invention has been described in relation to particular embodiments thereof, many other variations and modifications will become apparent to those skilled in the art. As such, it will be readily evident to one of skill in the art based on the detailed description of the presently preferred embodiment of the bra cup explained herein, that different support and augmentation characteristics can also be realized by varying the number of layers, the particular materials chosen for those layers, the specific shape of the first and second portions, etc., the present invention being limited only by the claims appended hereto.

What is claimed is:

1. A bra cup, comprising:

an inner cup portion comprising one or more inner layers, at least one layer of the one or more inner layers having a surface with a spline-shaped cross-sectional curvature that extends between an upper edge and a lower edge of the bra cup; and an outer cup portion, attached to the inner cup portion, comprising one or more outer layers, the inner cup portion and the outer cup portion together forming the bra cup, wherein the inner cup portion is configured to support a wearer's breast of a first cup size, and to uplift and push the breast inwardly towards an opposite breast of the wearer, and wherein the outer cup portion is configured to have a second cup size at least two cup sizes larger than that of the first cup size.

2. The bra cup according to claim 1, wherein the one or more outer layers are dimensioned and arranged to form a projecting portion at an apex of the bra cup.

3. The bra cup according to claim 1, the inner cup portion further comprising a fabric liner fixedly attached to an inner surface of the inner cup portion.

4. The bra cup according to claim 3, wherein the fabric liner is laminated to the inner surface of the inner cup portion.

5. The bra cup according to claim 1, wherein the at least one layer of the one or more inner layers is a foam material.

6. A bra comprising:

(a) two bra cups, adjacent to one another at inner edge portions thereof, each bra cup comprising:

an inner cup portion, comprising one or more inner layers, at least one layer of the one or more inner layers having a surface with a spline-shaped cross-sectional curvature that extends between an upper edge and a lower edge of the bra cup; and an outer cup portion, attached to the inner cup portion, comprising one or more outer layers, the inner cup portion and the outer cup portion together forming the bra cup, wherein the inner cup portion is configured to support a wearer's breast of a first cup size, and to uplift and push the breast inwardly towards an opposite breast of the wearer, and wherein the outer cup portion is configured to have a second cup size at least two cup sizes larger than that of the first cup size; and (b) at least one bra wing extending from outer edge portions of the bra cups.

7. The bra according to claim 6, wherein the one or more outer layers form a projecting portion at an apex of the bra cup.

8. The bra according to claim 6, the inner cup portion further comprising a fabric liner fixedly attached to an inner surface of the inner cup portion that contacts the breasts of the wearer.

9. The bra according to claim 8, wherein the fabric liner is laminated to the inner surface of the inner cup portion.

10. The bra according to claim 6, wherein the at least one layer of the one or more inner layers is a foam material.

11. A bra cup, comprising:

an inner cup portion of a first cup size, comprising one or more inner layers, at least one layer of the one or more inner layers having a surface with a spline-shaped cross-sectional curvature that extends between an upper edge and a lower edge of the bra cup; and an outer cup portion of a second cup size, at least two cup sizes larger than the first cup size, attached to the inner cup portion, comprising one or more outer layers, the inner cup portion and the outer cup portion together forming the bra cup, the inner cup portion being configured to support a wearer's breast of the first cup size, and to uplift and push the breast inwardly towards an opposite breast of the wearer.

12. The bra cup according to claim 1, wherein the one or more inner layers of define first and second convex portions with respect to an inner surface of the inner cup portion, the first and second convex portions delineating, at an intersection therebetween, a channel on the inner surface of the inner cup portion, the channel extending from a lower portion of the bra cup towards an apex of the bra cup.

13. The bra according to claim 6, wherein the one or more inner layers of define first and second convex portions with respect to an inner surface of the inner cup portion, the first and second convex portions delineating, at an intersection therebetween, a channel on the inner surface of the inner cup portion, the channel extending from a lower portion of the bra cup towards an apex of the bra cup.

14. The bra cup according to claim 11, wherein the one or more inner layers of define first and second convex portions with respect to an inner surface of the inner cup portion, the first and second convex portions delineating, at an intersection therebetween, a channel on the inner surface of the inner cup portion, the channel extending from a lower portion of the bra cup towards an apex of the bra cup.

15. The bra cup according to claim 1, further comprising a flange attached to the lower edge of the bra cup.

16. The bra cup according to claim 6, further comprising a flange attached to the lower edge of the bra cup.

17. The bra cup according to claim 11, further comprising a flange attached to the lower edge of the bra cup.

* * * * *